US006750448B2

(12) United States Patent
Turecek et al.

(10) Patent No.: US 6,750,448 B2
(45) Date of Patent: Jun. 15, 2004

(54) PREPARATIVE SEPARATION OF MIXTURES BY MASS SPECTROMETRY

(75) Inventors: Frantisek Turecek, Seattle, WA (US); Adi Scheidemann, Seattle, WA (US); Terry Olney, Mountain Terrace, WA (US); Frank J. Schumacher, Fall City, WA (US); Martin Smrcina, Tucson, AZ (US); Peter Strop, Tucson, AZ (US); Marcel Patek, Tucson, AZ (US); Daniel Schirlin, Bad Soden (DE)

(73) Assignees: University of Washington, Seattle, WA (US); Aventis Pharmaceuticals, Inc., Bridgewater, NJ (US)

( * ) Notice: Subject to any disclaimer, the term of this patent is extended or adjusted under 35 U.S.C. 154(b) by 0 days.

(21) Appl. No.: 10/386,127

(22) Filed: Mar. 10, 2003

(65) Prior Publication Data

US 2003/0197121 A1 Oct. 23, 2003

Related U.S. Application Data

(60) Provisional application No. 60/362,860, filed on Mar. 8, 2002.

(51) Int. Cl.[7] ..... H01J 49/30
(52) U.S. Cl. ..... 250/281
(58) Field of Search ..... 250/288, 282, 250/287, 281

(56) References Cited

U.S. PATENT DOCUMENTS

| | | | | | |
|---|---|---|---|---|---|
| 5,661,298 | A | * | 8/1997 | Bateman | 250/281 |
| 6,194,717 | B1 | * | 2/2001 | Hager | 250/292 |
| 6,259,091 | B1 | * | 7/2001 | Eiden et al. | 250/281 |
| 6,423,965 | B1 | * | 7/2002 | Hashimoto et al. | 250/288 |
| 6,469,295 | B1 | * | 10/2002 | Park | 250/282 |
| 2002/0109104 | A1 | | 8/2002 | de la Mora et al. | 250/492.2 |

OTHER PUBLICATIONS

Bromann, K. et al. (1997), "Hard and soft landing of mass–selected Ag clusters on Pt(111)," Surf. Sci. 377–379:1051–1055.

Bromann, K. et al. (1996), "Controlled deposition of size–selected silver nanoclusters," Science 274:956.

Feng, B. et al.(1999), "Retrieval of DNA using soft landing after mass analysis by ESI–FTICR for enzymatic manipulation," J. Am.Chem. Soc. 121:8961–8962.

Geiger, R. J. et al. (1999), "Modifications to an analytical mass spectrometer for the soft–landing experiment," Int. J. Mass Spectrom. Ion Processes 182/183:415–422.

Godbout, J. T. et al. (1996), "Matrix isolation of mass–selected cations: Are counterions present and how are they formed?" J. Phys. Chem. 100:2892–2899.

Kofel, P. et al. (1991), "A Novel Quadrupole, Quistor, Quadrupole Tandem Mass Spectrometer," *Org. Mass Spectrom.* 26:463–467.

Love, L. (1973), "Electromagnetic separation of isotopes at Oak Ridge," Science 182:343–352.

(List continued on next page.)

*Primary Examiner*—John R. Lee
*Assistant Examiner*—Johnnie L Smith, II
(74) *Attorney, Agent, or Firm*—Greenlee, Winner and Sullivan, P.C.

(57) ABSTRACT

The present invention provides an instrument and methods for the preparative separation of components of mixtures using mass spectrometric methods. Nondestructive ionization methods are employed to generate ionized components of a mixture, the ionized components are spatially separated by mass and the mass-separated ion components are trapped. The ion source and mass spectrometric techniques employed allow the generation of large ion currents of ion components, on the order of nanoamps, which facilitate rapid accumulation of nanomole quantities of mass-separated components in relatively short times (minutes to hours).

28 Claims, 10 Drawing Sheets

OTHER PUBLICATIONS

Luo, H. et al. (1998), "Soft landing of polyatomic ions for selective modification of fluorinated self–assembled monolayer surfaces," Int. J. Mass Spectrom. Ion Processes 174:193–217.

McDowell,C. A. (1963) (ed.) *Mass Spectrometry*, McGraw–Hill, New York pp. 210–216.

Miller, S.A. et al. (1997), "Soft–landing of polyatomic ions at fluorinated self–assembled monolayer surfaces," Science 275:1447–1450.

Nacer, B. et al. (1997), "Deposition of metallic clusters on a metallic surface at zero initial kinetic energy. Evidence for implantation and site exchages," Phys. Rev. B 56:10590–10595.

Nier, A. O. and Schlutter, D. J. (1985) "High–performance double–focusing mass spectrometer," Rev. Sci. Instrum. 56:214–219.

O'Connor, P.J. et al. (1991), "Understanding Ion Deceleration Lenses: What Are the Simplicity/Performance Trade–Offs?" *J. Am. Mass. Spectrom*. 2:322–335.

Shaffer, S. A. et al. (1997), "A novel ion funnel for focusing ions at elevated pressure using electrospray ionization mass spectrometry," Rapid. Comm. Mass Spectrom. 11:1813–1817.

Shaffer, S. A. et al. (1998), "An ion funnel interface for improved ion focusing and sensitivity using electrospray ionization mass spectrometry," Anal. Chem. 70:4111–4119.

Shaffer, S. A. et al. (1999), "Characterization of an improved electrodynamic ion funnel interface for electrospray ionization mass spectrometry," Anal. Chem. 71:2957–2964.

Shen, J. W. et al. (1999), "Soft landing of ions onto self–assembled hydrocarbon and fluorocarbon monolayer surfaces," Int. J. Mass Spectrom. 182/183:423–435.

Shen, J. W. et al. (1999), "Chemical modification of fluorinated self–assembled monolayer surfaces using low–energy ion beams for halogen and pseudohalogen transfer," J. Mass Spectrom. 34:354–363.

Shen, J. W. et al. (1999), "Ion—ion collisions leading to formation of C—C bonds at surfaces: An interfacial Kolbe reaction," J. Am. Chem. Soc. 121:9762–9763.

Siuzdak, G. et al. (1996), "Mass Spectrometry and viral analysis," Them. Biol. 3:45–48.

Smith, L P. et al. (1947), "On the Separation of Isotopoes in Quantity by Electromagnetic Means," Phys. Rev. 72:989–1002.

Turecek, F.et al. (1992), "Novel Tandem Quadrupole–Acceleration–Deceleration Mass Spectrometer for Neutralization–Reionization Studies," *J. Am. Soc. Mass Spectrom* 3:493–501.

Vestal, M.L. et al. (1976), "New crossed–beam apparatus for the stud of ion–molecule collision processes," *Rev. Sci. Instrum*. 47:15–26.

Yergey, A. L. and Yergey, A. K. (1997), "Preparative scale mass spectrometry: A brief history of the Calutron," J. Am. Soc. Mass Spectrom. 8:943–953.

* cited by examiner

Molecular weight = 500.17
Molecular formula = C24H28N4O6S

Moleculat Weight = 479.22
Molecular Formula = C25H29N5O5

PREPARATIVE SEPARATION OF MIXTURES BY MASS SPECTROMETRY

CROSS-REFERENCE TO RELATED APPLCIATIONS

This application takes priority under 35 U.S.C. §119(e) from U.S. provisional application 60/362,860 filed Mar. 8, 2002, which is incorporated by reference in its entirety herein.

BACKGROUND OF THE INVENTION

This invention is in the field of mass spectrometry and more specifically relates to the separation, collection and quantification of components of mixtures using a magnetic analyzer coupled with a collection array. The method is of particular application to separation of biologically-active components from mixtures from biological samples such as natural products, peptides, polynucleotides, proteins and polysaccharides. Biological samples include various types of samples (gas, liquid, or solid) from various biological environments, e.g., various human or veterinary medical samples (blood, urine, etc.), samples of bacteria, fungi or other microorganisms; water, soil of air samples, etc.)(gas, liquid, or solid.) The method is also useful for the separation of synthetic organic components from complex mixtures, such as combinatorial libraries.

Mass spectrometers use various combinations of electric and magnetic fields to achieve spatial or temporal separation of ions in the rarefied gas phase (1). In addition to the analytical utility of mass spectrometry, spatial separation of ions by mass spectrometric methods has been considered previously in conjunction with preparative separation of selected components of mixtures. For example, mass spectrometers were used in the Manhattan Project for the separation of the $^{235}U$ isotope from the much more abundant $^{238}U$ isotope (2–4). The mixture of isotopes was atomized and ionized in an efficient ion source, separated by a homogeneous magnetic field and landed on a collector. This was done under destructive conditions that excluded survival of molecular species because of the ionizing conditions and the high kinetic energies with which the ions impinged on the collector (3,4). Recently several attempts have been made to soft land gas phase ions following mass separation by a mass spectrometer (5–17). The term "soft landing" usually refers to and is used herein to refer to, non-destructive capture of a gas-phase ion on a target, such that it can be retrieved from the vacuum system of the mass spectrometer and identified or otherwise analyzed or used. Soft landing is not always required for identification of a mixture component, but is essential for efficient, high-yield preparative separation of mixture components for further analysis, functional assays or use. Mass separation or separation by mass refers to separation of ions possessing different mass to charge ratios (m/z). When the ions generated are singly charged, m/z values can be replaced by and referred to as masses.

Examples of soft landing of ions include a polypropylene glycol oligomer (5), chlorobenzyl ions (6), sulfonium ions (7), a mixture of multiply charged DNA fragments (8), $CO_2$ (9) and inorganic metal clusters (10–12). The targets used for soft landing of ions include metal surfaces (5, 7), inert gas matrices (9–12), nitrocellulose membranes (8) and self-assembled monolayers (6,13,14). Mass separation in these examples was achieved by mass spectrometers including quadrupole mass filters (5,6,9,13–16), a sector instrument (7), and an ion-cyclotron resonance instrument (8).

These references all exemplify single-channel ion collection and isolation. In single-channel collection, ions are mass selected by tuning a mass spectrometer to a selected mass and collecting only ions having the selected mass. Collection of a second ion requires retuning of the mass spectrometer to select the mass of the second ion and collection of the second ion. The application of single-channel ion collection to component separation can be prohibitively time consuming for practical application, particularly when separation of multiple components of complex mixtures is desired.

Thus, prior art efforts to achieve separation can be characterized as single-channel isolation of mass-selected ions in slightly modified commercial or existing mass spectrometers. The yields of soft-landed ions using such methods have not been quantified. Feng et al. (8) estimate capture of attomole amounts of DNA, while Geiger et al. (7) report reanalysis of a soft-landed sample collected "overnight" by fast-atom bombardment mass spectrometry, which typically requires at least picomole amounts of sample. Thus, while the prior art suggests that soft landing of a variety of mass-selected gas phase ions is possible, the implementation of component separation using soft landing of ions lacks practical implementation.

There remains a significant need in the art for improved mass spectrometer-based methods for separation of components of mixtures that are sufficiently efficient and high yield for practical application.

SUMMARY OF THE INVENTION

The present invention provides an instrument and methods for the preparative separation of components of mixtures using mass spectrometric methods. Nondestructive ionization methods are employed to generate ionized components of a mixture, the ionized components are spatially separated by mass and the mass-separated ion components are trapped. The ion source and mass spectrometric techniques employed allow the generation of large ion currents of ion components, on the order of nanoamps, which facilitate rapid accumulation of nanomole quantities of mass-separated components in relatively short times (minutes to hours).

The method of this invention can, for example, provide several nanomoles of a compound of interest for 10 h of collection of ions generated at 10 nA ion current by electrospray ionization. The amount of time needed to accumulate a nanomole of material depends on the abundance of the component in a mixture (e.g., its molarity) and the ionization efficiency of the component (e.g., its electrospray ionization efficiency). In order to obtain 10 picomol of a biological sample for biological testing, the collection time would be about 100s for an ion generated at about 10 nA ion current and about 1000s for an ion generated at about 1 nA ion current. Products can be collected at a rate of about 10 picomole/h or more and, preferably, at a rate of about 50 picomole/h or more. Note that the collection time for multiple components from the same sample is significantly decreased in the method of this invention because multiple components can be mass dispersed and collected simultaneously. A plurality of ion components from a mixture can typically be collected in less time than has been needed in prior art methods to collect a single ion component.

Typical samples for preparative electrospray mass spectrometry are in the range of about $5\times10^{-5}$ to about $1\times10^{-4}$ M/component. Samples for preparative electrospray mass spectrometry are typically solutions in volatile water-miscible solvents, such as water, volatile alcohols (methanol, ethanol, etc.) acetonitrile, nitromethane, tetrahydrofuran, and volatile organic acids (formic acid, acetic acid, propionic acid, etc.).

Mixtures are subject to non-destructive ionization, preferably using atmospheric pressure ionization techniques, such as electrospray ionization or atmospheric pressure chemical ionization techniques, to generate ionized components of the mixture. These ionized components are transmitted into a high vacuum region, where they are accelerated to high kinetic energy (on the order of kilo electron volts, keV). The ions generated in the ion source at higher pressures (about 1 Torr) are transported employing ion lensing and ion guiding to the high vacuum region (about $10^{-6}$ Torr). Accelerated ions are energy selected in an electrostatic analyzer and passed into a magnetic analyzer where they are dispersed by mass. The mass-dispersed ions are decelerated to low kinetic energy (about 15 eV or less) and trapped on a collector array where the location of trapping on the array depends on the mass of the trapped ion. Ions can, for example, be collected according to mass into an array of collector compartments or bins. Bins or compartments are sized, spaced and arrayed along the length of the collector each to receive ionic species of different m/z or to receive ionic species having m/z of a selected range.

Mass separation occurs simultaneously for all ion components providing a 100% duty cycle. Trapping of all mass-separated ions also occurs simultaneously allowing for multiplex separation which facilitates analysis or biological testing of separated components. Ion generation, mass-separation and ion-trapping of all components are continuous for a given sample and do not require mass scanning or mechanical movement of the collector array to achieve separation of components. The instrumentation and method of this invention are particularly well suited to separation and analysis of complex mixtures, for example, complex samples from biological sources. The instrumentation and method of this invention can, for example, be employed in the separation and screening of natural product mixtures (e.g., including, peptides, proteins or polynucleotides) as well as combinatorial libraries (e.g., including various organic species or biological molecules (including peptides, proteins, and polynucleotides) for the identification of components with desirable biological or chemical properties or reactivity. The method is efficient and high yield rapidly providing sufficient amounts of separated materials (picomole quantities or greater) for functional, chemical or other types of analysis. In contrast to other methods for separating compounds by molecular weight (e.g. capillary electrophoresis, diffusion methods, etc.), the current invention can provide separation of relatively small molecules according to their mass/charge ratios at a resolution approaching 1 Dalton mass difference.

The use of high velocity ions reduces space-charge effects allowing the generation of high ion currents in the instrument. The high kinetic energy ions can nevertheless be soft-landed onto a collection surface at low velocity and kinetic energy by use of a deceleration lens to maximize non-destructive capture of mixture components. The collection surface can be, for example, a conducting metal, a polymer, or more generally, any non-volatile matrix. When it is desired to capture mixture components without substantial structural change, the collection surface preferably does not react with the ionic species that are landed. The collection surface may however, function to neutralize the charge of the ionic species landed. Alternative, it may be desirable to land the ionic species on a collection surface that is reactive to generate a desired reaction product of the landed species. Furthermore, it may be desirable to land the ionic species at a controlled velocity and kinetic energy to generate fragments or to enhance reactivity of the ionic species at the surface. The ions can be concurrently quantified by recording the ion current at selected points along the collector array, for example, in one or more collector bins or compartments of the collector array, such that the total amount of material collected in each bin over a given time period can be determined. The measured ion currents can provide relative amounts of different components in the mixtures being analyzed and separated. Further, absolute amounts of a given component present can be determined with such measurement by employing mass-distinguishable internal standards.

In a preferred embodiment, a linear dispersion magnet is employed for mass separation of high velocity ionized components which avoids mass compression and potential loss of mass resolution at higher mass to charge ratios. Trapping can be performed using a linear collector array with equidistant bins. In another preferred embodiment, the soft-landed ions are neutralized by ion-pairing with counter-ions produced by electrolytic reduction of an auxiliary electrolyte to diminish side reactions and minimize or avoid chemical modification of trapped components.

The mass spectrometry-based method and instrument of this invention allows multichannel separation of ionized components of a mixture by mass, followed by non-destructive trapping of mass-separated ionized components, charge neutralization of ionized components and collection of separated mixture components.

In a specific embodiment, the invention provides a method of separation of mixture components comprising the steps of:

(a) nondestructive ionization of mixture components to generate ionized components;

(b) transmission of ionized components into a high vacuum region with simultaneous collisional cooling to near-thermal kinetic energies;

(c) acceleration of the ionized components having near-thermal kinetic energy to high kinetic energy (equal to or greater than about 1 keV) and refocusing of the accelerated ions to provide a focused ion beam for introduction into a kinetic energy analyzer;

(d) energy dispersion and spatial refocusing of the refocused accelerated ionized components as a function of their entrance trajectories and initial kinetic energy (i.e., kinetic energy after acceleration) to provide ionized components of selected kinetic energy for mass dispersion;

(e) mass dispersion and velocity refocusing of the ionized components of selected kinetic energy to generate mass separated ionized components;

(f) deceleration of the mass-separated ion components to a selected velocity and kinetic energy; and (g) trapping of ion components separated by mass.

The method of this invention is carried out to obtain a desired amount of separated, trapped components of a mixture. The time that will be required to accumulate a desired amount of material is readily determined empirically for a given sample, the type and number of components in a sample and the amount of a given component in a sample that is to be collected. Non-destructive ionization can be carried out using any atmospheric pressure ionization method, but electrospray ionization (ESI) is particularly useful. ESI is typically carried out at ambient atmospheric pressure and the ionized components must then be transmitted to a region of high vacuum (about $10^{-6}$ Torr) for mass separation. Mass dispersion of the accelerated, ionized components can be carried out in a magnetic field, preferably in a linear magnetic analyzer, resulting in linear mass dispersion of ions. The ions can be decelerated to a desired kinetic energy and in a preferred embodiment the ions are decelerated to a sufficiently low kinetic energy to minimize fragmentation on landing.

The method of the invention can be carried out in a mass spectrometer system comprising, in sequence along an ion's trajectory through the system, an electrospray ion source, one or more ion guides, an ion acceleration lens, an electrostatic analyzer, a magnetic analyzer, a deceleration lens and a collector array with suitable ion transmission or transfer devices between device elements. The device elements other than the ion source are contained in a multichamber vacuum housing in which operating pressures are maintained by one or more pumping systems. The instrument employs appropriate differential pumping and conductance limits (determined by apertures size) between the chambers to achieve appropriate pressure levels in the different chambers.

As an alternative to an ESI source, an atmospheric pressure chemical ionization (APCI) source can be employed in the method of this invention. Atmospheric pressure chemical ionization is related to ESI and the ion source is similar to an ESI ion source. In addition to the electrohydrodynamic spraying process of ESI, a plasma is created by a corona-discharge needle at the end of the metal capillary. In this plasma, proton transfer reactions and some fragmentation can occur. Depending on the solvent used, only quasi molecular ions like $[M+H]^+$, $[M+Na]^+$ and $M^+$ (in the case of aromatics), and/or fragments can be produced. Multiply charged molecules are typically not observed.

Both APCI and ESI provide molecular and quasi-molecular ions from which molecular weight information can be derived and as such are useful for the preparative method of this invention. ACPI is generally suitable for analyzing less polar compounds than ESI, but generally exhibits increased fragmentation compared to ESI. ACPI can provide coupling for samples at sampling flow rates up to about 1 ml/min.

Ionized components of the mixture are generated in the ion source at relatively high pressure, transmitted to a high-vacuum region, and accelerated by the acceleration lens to a selected high kinetic energy. Accelerated ions are passed through an electrostatic analyzer to disperse the ions by kinetic energy and focus them into a nearly paraxial beam (Mattauch-Herzog double focusing.) In the Mattauch-Herzog geometry, the electrostatic sector analyzer (ESA) refocuses the ions so that the velocity dispersion of the beam exiting the ESA can be compensated by the velocity dispersion of the magnet. Ions of paraxial trajectories are introduced into a magnetic analyzer which refocuses the ions by velocity and disperses the ions by mass, so that the ions can be trapped or collected as a function of mass. Ions are spatially separated by mass in the magnetic analyzer so that mass separation of components can be achieved by spatially-selective collection of mass-separated ions.

In an instrument of this invention, a collector array can be arranged to receive ions dispersed by mass by passage in the magnetic analyzer. Prior to collection the ions pass through a deceleration lens to decrease their velocity and kinetic energy to facilitate nondestructive landing on the collector array. The ions also pass through an optional, but preferred, deflector lens after exiting the magnet.

In a specific embodiment, the mass spectrometer-ion collection instrument of this invention comprises:

- an atmospheric pressure chemical ionization (APCI) ionizer or an electrospray ionizer (ESI) for receiving a liquid sample containing one or more components and for generating one or more ionized components of the sample;
- an ion transmission assembly for transmitting the one or more ion components generated by the electrospray ionizer into an acceleration lens;
- an acceleration lens for imparting selected high kinetic energy to the one or more ionized components generated by the electrospray ionizer;
- an electrostatic analyzer for dispersing and focusing the one or more accelerated ionized components as a function of kinetic energy and transmitting the one or more ionized components of selected kinetic energy;
- a magnetic analyzer for receiving the one or more ionized components of selected high kinetic energy and for dispersing the ions received as a function of mass;
- one or more electrostatic potential shielding devices (e.g., Faraday cages) between the acceleration lens and the electrostatic analyzer and between the electrostatic analyzer and the magnetic analyzer to transmit the one or more ionized components of selected high kinetic energy without loss or gain of kinetic energy;
- an electrostatic deflector to simultaneously bend the trajectories of all mass-dispersed ions exiting the magnet analyzer and correct the trajectories for acceptance by the deceleration lens;
- a deceleration lens intercepting the path of the one or more ionized components dispersed in the magnetic analyzer for decreasing the kinetic energy of the one or more mass-dispersed, ionized components; and
- a collector array positioned to intercept the paths of the one or more decelerated, mass-dispersed ionized components from the magnetic array to spatially collect ions as a function of mass.

In a specific embodiment, the electrospray ionizer comprises a heated ion transfer interface with a counter flow of bath gas for receiving charged droplets and ionized components of sample generated in the electrospray ionizer and facilitating desolvation of the charged droplets to form ionized components of the sample. Further in a specific embodiment the ion transmission assembly comprises: a funnel lens for receiving ionized components from the ion transfer interface of the ionizer and an octopole ion guide for receiving ionized components exiting the funnel lens and transporting the ions to the acceleration lens. On passage through the octopole ion guide, ions undergo collisions with residual background gas for translational cooling. Extraction ion optics between the octopole and the acceleration lens comprise an extraction lens for extracting ions from the octopole and an Einzel lens for refocusing the ions into the acceleration lens.

In a specific embodiment, the vacuum housing of the instrument comprises four compartments or chambers which are held at different pressures and are separated by low conductance apertures. The ion transfer interface and funnel lens are held at a pressure of about 0.1 to 5 Torr (Chamber 1). The octopole ion guide is held at about $5\times10^{-4}$ to $1\times10^{-2}$ Torr (Chamber 2). The acceleration lens and electrostatic analyzer are held at a pressure of about $1–5\times10^{-6}$ Torr (Chamber 3). The collector, deflector and deceleration lens are housed in Chamber 4 which is connected to the magnetic field tube and held at a pressure of $1\times10^{-6}$ to $1\times10^{-5}$ Torr.

In a preferred embodiment, the magnetic analyzer is a linear magnetic analyzer as described in U.S. Pat. No. 6,182,831 (issued Feb. 6, 2001) which is incorporated by reference herein in its entirety for the description of a linear magnetic analyzer.

The specific combination of device elements in the specific embodiments herein facilitate efficient separation and rapid collection of components of sample mixtures.

The invention also relates to a method for collecting ionic species at rates sufficiently high for practical application. The instrument of this invention can be employed, for example to generate and collect ionic species at rates of 10 picomoles/h or higher. More specifically, the invention provides a method for collecting or landing of ionic species into a matrix or onto a substrate at the collector. Ions can be soft landed without significant fragmentation or rearrangement. Alternatively, ions can be landed with a selected, controlled kinetic energy allowing ion rearrangement, ion fragmentation and/or ion reaction. In another alternative, the ions and the matrix or substrate can be selected such that the matrix or substrate is modified, either functionally, chemically or structurally by the ions captured. Of particular interest are matrices of inorganic or organic polymers which can be modified by reaction or interaction with one or more ions.

DETAILED DESCRIPTION OF THE INVENTION

The present invention provides a preparative mass spectrometer for multichannel separation of ions by mass, followed by soft landing or landing at a selected energy, charge neutralization, simultaneous collection of mass-separated molecular species and optional quantitation.

Figure 1A:
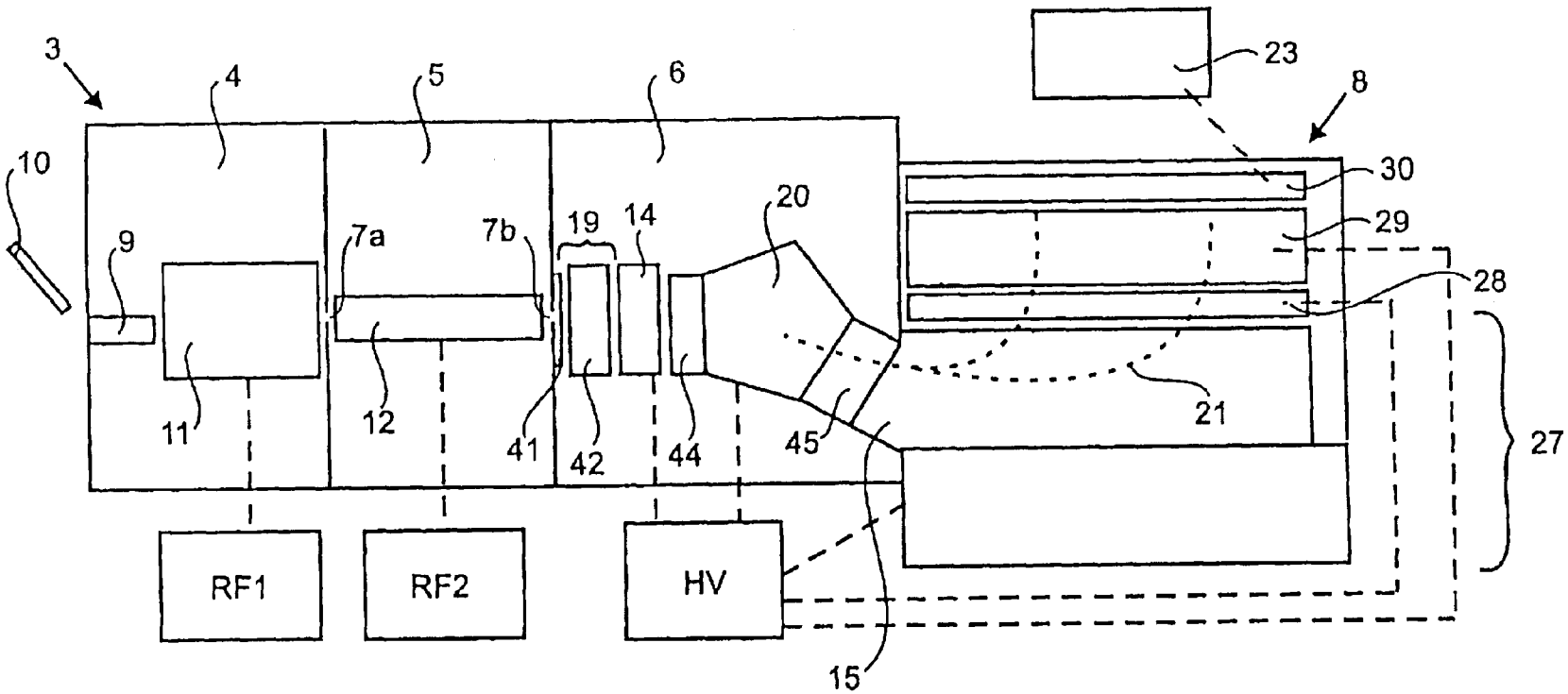
FIG. 1A is a schematic illustration of a multichannel ion collection device of this invention.

In general the instrument of this invention provides for nondestructive ionization of mixture components in an ion source. Ions generated are transported to a region of high vacuum where they are accelerated to high kinetic energy, energy selected, and introduced into a magnetic field in order to spatially disperse the ions by charge to mass ratio (m/z) (for singly-charged ions m/z is simply the mass of the ion). Spatially-separated ions are collected to preserve their separation (e.g., on a collector array spanning the spatial dispersion of the ions). The trapped ions are neutralized (or reacted, fragmented or rearranged) and can then be isolated on a preparative scale preferably to provide sufficient quantities of material for biological or functional analysis. Ions can be soft-landed at KE of 15 eV or less or landed at a selected KE using a deceleration lens. The multichannel separator of this invention is schematically illustrated in FIG. 1A.

The instrument is configured in a vacuum housing comprising four chambers equipped for differential pumping. The main housing (3) is divided into three chambers (4–6) which are separated by narrow apertures (7*a* and *b*) providing conductance limits. The magnet and collection array is housed in a fourth chamber (8) connected to the main housing by a magnetic flight tube (15, shown in more detail in FIG. 1B). The desired pressure level in each chamber is maintained by differential pumping using conventional pumping methods known in the art.

Ions are generated in ion source 10 which in the exemplified system is an atmospheric pressure source (1–10 Torr) which is external to the vacuum housing. In a specific embodiment the ion source is an electrospray ionization source. A heated ion transfer interface is provided to introduce ionized components formed in the ion source into chamber 1 of the main housing which is held at a pressure of from 0.1 to 5 Torr. Ion lenses, ion guides, ion extractors and related known devices are combined to transport the ionized components to a high vacuum region in chamber 3 of the main housing. An exemplary ion source and ion transfer element are described below with reference to FIG. 2.

More specifically, ions exiting the ion transfer interface (9) are accelerated by application of a voltage at the end of the interface into an ion lens (11) which focuses the ions to the aperture (7*a*) between chambers 1 and 2. In a specific embodiment the ion lens is a funnel lens (30) which is described below with reference to FIG. 3. In a funnel lens, a radiofrequency (a.c. voltage) component is applied, as known in the art, to radially compress the ion beam and allow the ions to be transmitted through a small aperture into the next chamber. Axial ion motion in the funnel lens is provided by the d.c. voltage component that is applied simultaneously to the lens element. A funnel lens is a high throughput device that works at high pressure where electrostatic lens do not work.

Ions entering chamber 2 which is held at a pressure of $10^{-2}$ to $10^{-4}$ Torr are guided through the chamber to the aperture between chambers 2 and 3 by an ion guide (12). In a specific embodiment described below the ion guide is a conventional octopole ion guide (35). More specifically, as described in more detail below, the octopole is a radiofrequency-only octopole. During passage through the ion guide, ions undergo collisions with residual background gas that lead to translational cooling. Ions are introduced into chamber 3 using extraction ion optics (19), which includes an extraction lens (41) and an Einzel lens (42) to refocus the ions.

Chamber 3 (6) is a high vacuum region ($1–5\times10^{-6}$ Torr) containing acceleration lens (14) which imparts a selected high kinetic energy to all ions. The acceleration lens also further focuses the ions for introduction into electrostatic analyzer 20. An exemplary acceleration lens is described below.

A preferred electrostatic analyzer has Mattauch-Herzog geometry (having a 31.82° angle, θ) dispersing the accelerated ions horizontally and focusing them into a nearly paraxial beam which facilitates double-focusing and enhances mass resolution in subsequent magnetic mass dispersion of the ions.

Faraday cages (44 and 45, FIG. 1B) are positioned on either side of the electrostatic analyzer to provide regions of well-defined potential so that accelerated ions reach the magnetic analyzer without significant loss or gain of kinetic energy. A loss or gain of energy of about 0.2% or less is acceptable.

Ions with well-defined kinetic energy and velocity dispersion exit the electrostatic analyzer entering a magnetic flight tube (not shown) which introduces the ions into the magnetic analyzer 27 where the ions are spatially dispersed in a magnetic field. In a preferred embodiment, described below, the magnetic analyzer is a linear dispersion analyzer. FIG. 1A illustrates the paths (e.g., 21) of ions linearly dispersed in the magnetic field. Dispersed ions are trapped or captured in a collector array 30. The trapping location of a ion along the collector array depends upon m/z ratio or mass for singly charged ions. To facilitate non-destructive collection of ions (i.e., to minimize ion fragmentation on trapping), ions are preferably decelerated by a deceleration lens (29) to a kinetic energy of 15 eV or less, and more preferably to 5 eV, or less before capture.

Figure 1B:
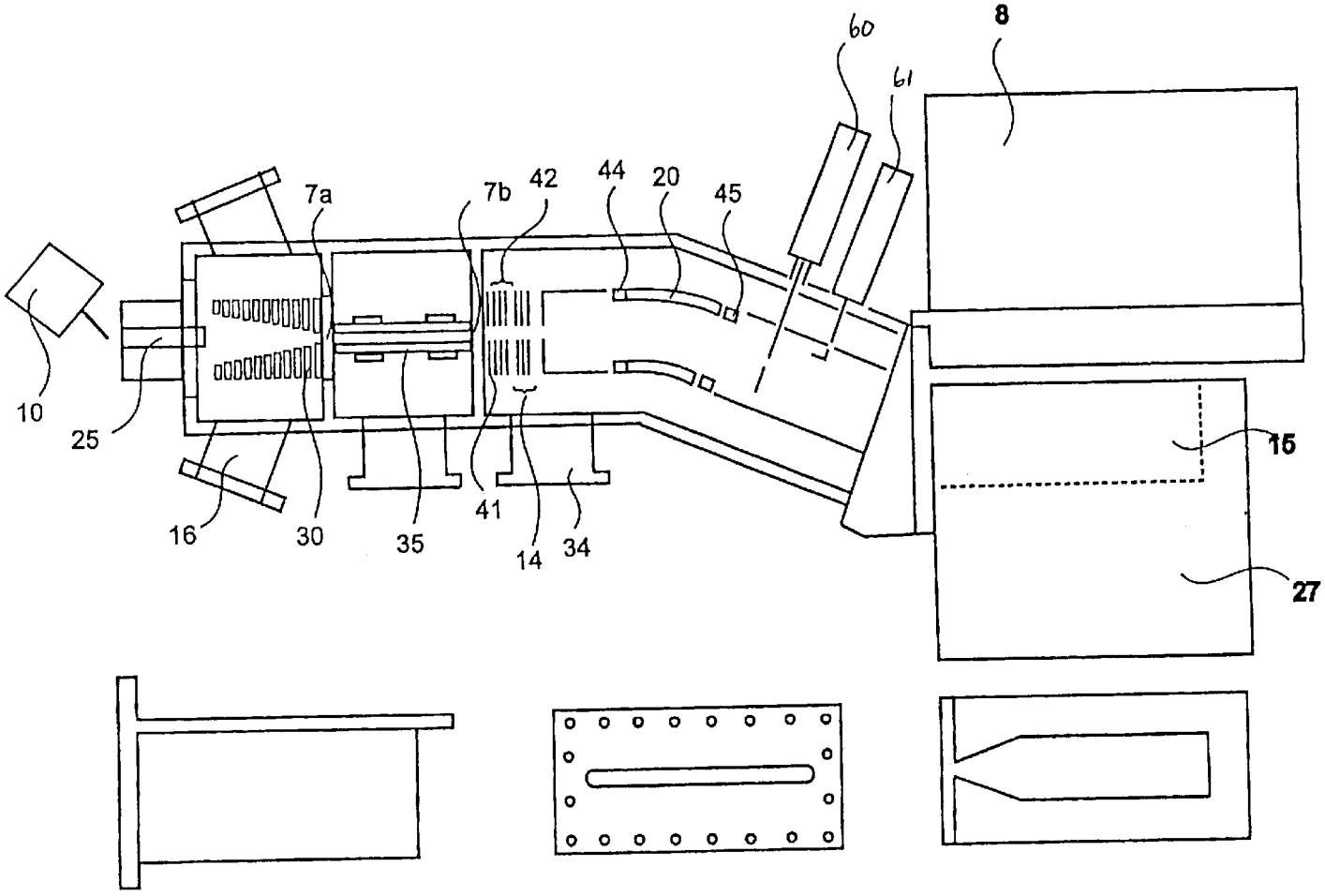
FIG. 1B is a schematic illustration of the multichannel ion collection device of FIG. 1A providing additional internal detail.
Figure 5A:
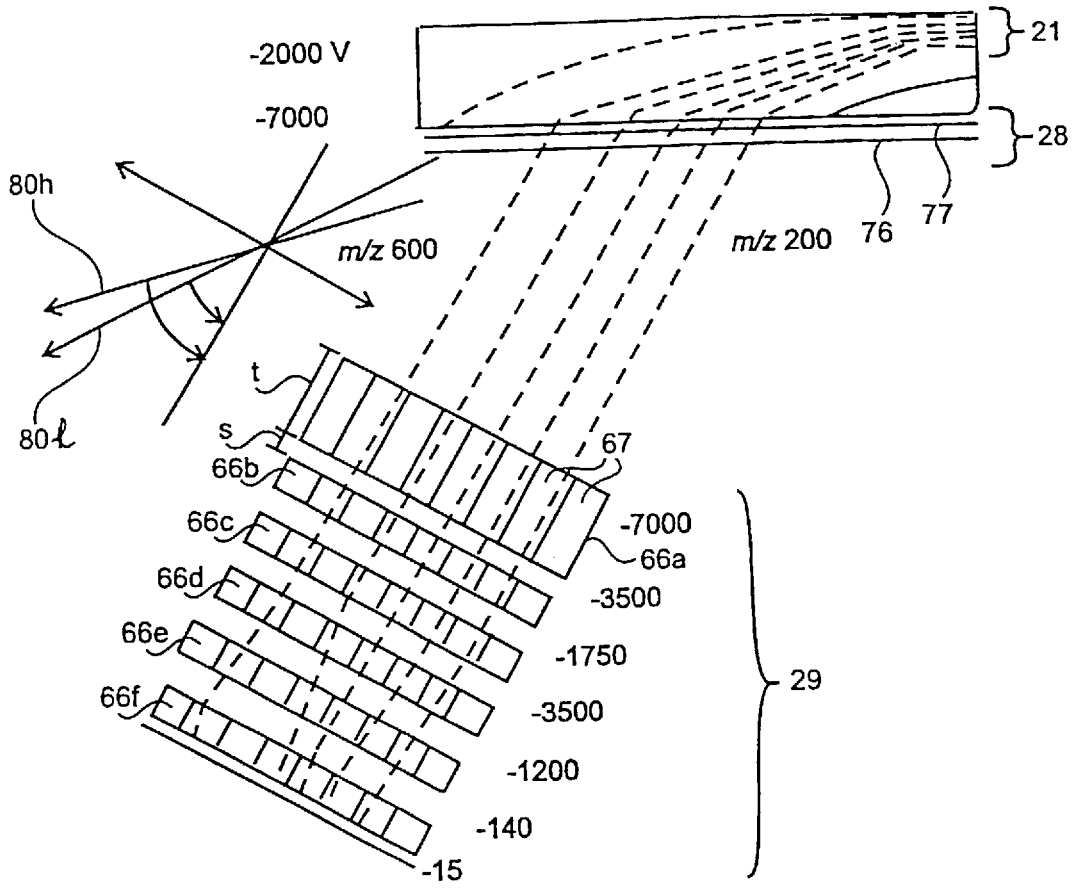
FIG. 5A is a schematic illustration of the magnetic analyzer, deflector, deceleration lens and collection array of this invention.

A deflection lens (28) is optionally positioned to intersect the paths of dispersed ions to redirect the ions so that they are approximately perpendicular to the collector array. The effect of a deflection lens on ion paths is illustrated in FIGS. 1A, 1B and 5A. In FIG. 1, the deceleration lens and deflection lens are illustrated as single device elements spanning the dispersed ion pathways. The collector array is also illustrated as a continuous strip spanning the dispersed ion pathways. Alternatively, the instrument can comprise a plurality of discrete bins for ion collection, with each bin spanning a range of masses (which may be of different breadth). In this configuration, a deceleration lens with optional deflection lens can be provided for each collection bin. Alternatively, a continuous collection array can be combined with a plurality of deceleration lens spanning a discrete range of masses.

FIG. 1A also schematically illustrates voltage supply (for RF I and RF 2 as well as for high voltage HV) to different elements of the instrument. In addition, a signal processing device 23 is illustrated for collecting and analyzing data. This device may combine signal amplification with signal collection and analysis. Signal processing may be performed by a MUX in combination with a signal amplifier.

In a specific embodiment the instrument of this invention for multichannel ion separation (MCS), comprises the following elements:

(1) Electrospray ionizer (FIG. 2)
(2) Ion transfer interface
(3) Ion funnel electrode (FIG. 3)
(4) Octopole ion guide (FIG. 1)
(5) Extraction ion optics
(6) Acceleration lens
(7) Faraday cages (FIG. 1)
(8) Electrostatic analyzer
(9) Linear dispersion magnet analyzer
(10) Electrostatic deflector
(11) Deceleration lens units and array
(12) Collector units and array
(13) Vacuum housing and pumps
(14) Power supplies (as needed) for d.c. voltage and radiofrequency.

In this preferred embodiment, the components cooperate to achieve efficient separation of mixtures. The components of this specific embodiment are described in more detail with reference to the figures as follows:

FIGS. 1A and 1B provide schematic illustrations of the preparative mass spectrometer ion collector of this invention.

Vacuum Housing and Differential Pumping (13 above)

Device elements are contained in vacuum housing (See FIG. 1A) which provides an environment for ion transport from the ion source to the collector array. There is a main housing (3, Chambers 1–3), the collector housing (8, Chamber 4) and a magnetic flight tube (15) connecting Chambers 3 and 4. The magnet flight tube is shaped to fit between the poles of the magnet and is electrically insulated from the main housing and the collector housing. The magnet flight tube (several different views of which (a, b and c) are shown in FIG. 1B, 15 in dotted lines in the magnetic sector) is maintained at the acceleration potential. The flight tube may be electrically insulated from the magnet, but preferably is not.

The main housing (a welded aluminum box) is divided by two bulkheads with selected conductance limits into three differentially pumped chambers. (Chambers 1–3, 4–6, respectively). The main housing is at ground potential. Chamber 1 contains the ion transfer interface (25) and funnel lens (30). It is pumped by a high throughput vacuum pump (e.g., a 70 Us mechanical booster pump or roots blower, the access flanges to the pump are illustrated in FIG. 1B, 16). The operating pressure is regulated between about 0.1–5 Torr.

Chamber 2 houses the octopole ion guide (35). It is held at an operating pressure of $5\times10^{-4}$ to $1\times10^{-2}$ Torr pumped e.g., by a 250 L/s turbomolecular pump. Chambers 1 and 2 are separated by a 1–2 mm aperture (7*b*) as a vacuum conductance limit. Chamber 3 houses the extraction ion optics (19), acceleration lens (41), the Faraday cages (44, 45), and the electrostatic sector analyzer (20). The ESA is held at an operating pressure of $1–5\times10^{-6}$ Torr, e.g., pumped by a 250 L/s turbomolecular pump (pump access flange 34 is illustrated in FIG. 1B. Chambers 2 and 3 are also separated by a 1–2 mm aperture (7*b*) as a conductance limit.

FIG. 1B also illustrates an optional slit or aperture (60) which can be selectively positioned within the instrument. The instrument also can be optionally provided with means for measuring the ion current, such as a charged particle detector (61).

Magnetic Flight Tube.

The magnet flight tube (15) connects Chamber 3 with the collector housing (Chamber 4). It can be made of nickel-coated stainless steel and attached by nonconductive polymer gaskets between Chambers 3 and 4. The magnet flight tube may be electrically insulated from the magnet, but preferably it is floated at the ion acceleration potential (as is the magnet.) The collector housing (Chamber 4) contains the deceleration lens (29) and the collector array (30) and can be machined from an aluminum block. Preferably it has sealable openings on top and two sides (not shown) to provide access to the collector array. The magnet flight tube (15) and Chamber 4 are differentially pumped to an operating pressure of $10^{-5}$ to $10^{-6}$ Torr, e.g., by a 250 Us turbomolecular pump (not shown). A deflector lens (28), optional, but preferred, is provided to redirect the ion trajectories exiting from the magnetic analyzer (27). Chamber 4 is electrically insulated from the magnet flight tube and is maintained at ground potential.

Electrospray Ionizer (ESI) and Ion Transfer Interface (1 and 2 above)

Figure 2:
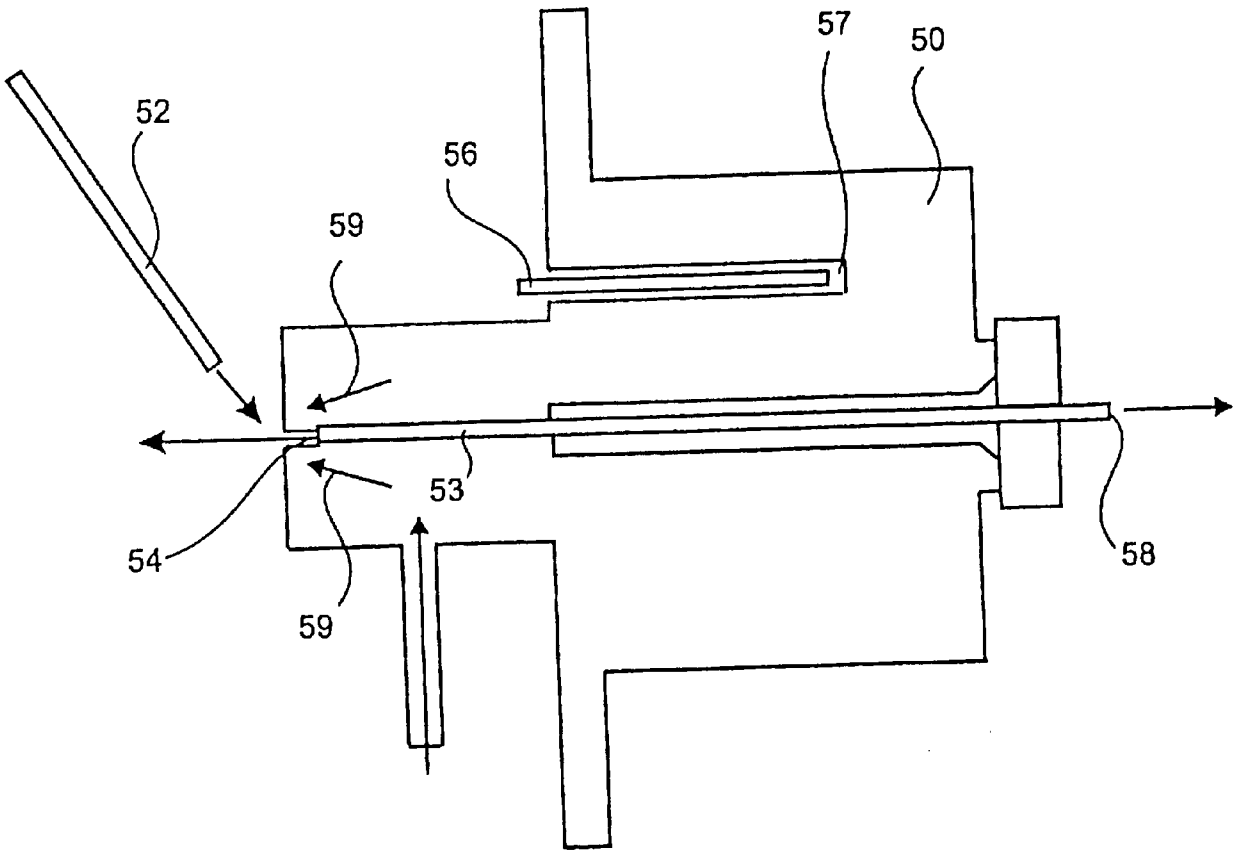
FIG. 2 is a schematic illustration of an exemplary ion transfer interface and its connection to a typically electrospray ionization source.

Ion transfer interface with the ion source is illustrated in more detail in FIG. 2. An ESI source serves for efficient formation of gas phase ions from solutions containing neutral or ionic compounds to be separated by the multichannel mass separator. As illustrated in FIG. 2, a conventional ESI comprises a stainless steel capillary (52) of 0.05–0.2 mm i.d. (the spray needle) which is mounted on a precision x-y-z axis manipulator (not shown). The needle is attached, for example, to a transfer line and a syringe (0.1–1.0 ml) on a linear syringe pump (Harvard Apparatus) that feeds sample solution at about 1–10 microliter flow rate. A stabilized d.c. voltage (typically in the 1.5–5 kV range) is applied to the needle to effect electrospray ionization. The needle is positioned close to the inlet capillary (53) of the ion transfer interface and transports ions into the first differentially pumped chamber (Chamber 1, see FIG. 1A). Liquid droplets that are dispersed from the needle are carried into the aperture of the capillary and transported by gas flow due to pumping into Chamber 1. These droplets continuously shrink due to evaporation during transport. The distance between the needle and the inlet capillary is typically 0.5–5 mm and the needle can be positioned on-axis or off-axis (as illustrated in FIG. 2) with respect to the inlet capillary. The ionizer provides up to 200 nA of gas-phase ion current, as measured in Chamber 1, by spraying 50–100 micro molar solutions of analytes.

The ion transfer interface (9) comprises a holder (50) carrying the stainless steel inlet capillary (53) (0.3–1.0 mm i.d). The inner surface of the capillary is coated with glass or other non-metallic materials to reduce ion loss due to neutralization by collisions with the surface. The capillary is mounted in the holder and is insulated electrically. The holder is provided with a heater core (56) positioned in a cavity (57) in the holder. Heating serves to promote evaporation of solvent from droplets formed in the electrospray ionizer. The typical operating temperatures are 100–200° C. A d.c. voltage of 100–1000 V is applied near the internal end of the inlet capillary (58) to provide ions with kinetic energy to enter Chamber 1. A counter flow of nitrogen or other gas (59) heated to about 100–200° C. is introduced near the external end of the inlet capillary (54) and used to aid droplet desolvation in the transfer interface. The heated gas exits through an opening on the atmospheric pressure side of the interface as illustrated by arrows in FIG. 2.

Funnel Lens (4, above)

Figure 3C:
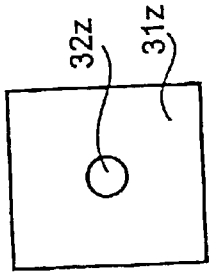
FIGS. 3B and 3C illustrate the first and last plates, respectively, in the funnel lens in views down the axis of the device.
Figure 3B:
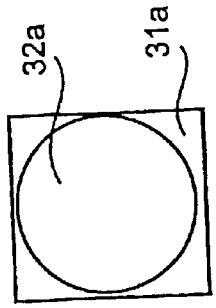
Figure 3A:
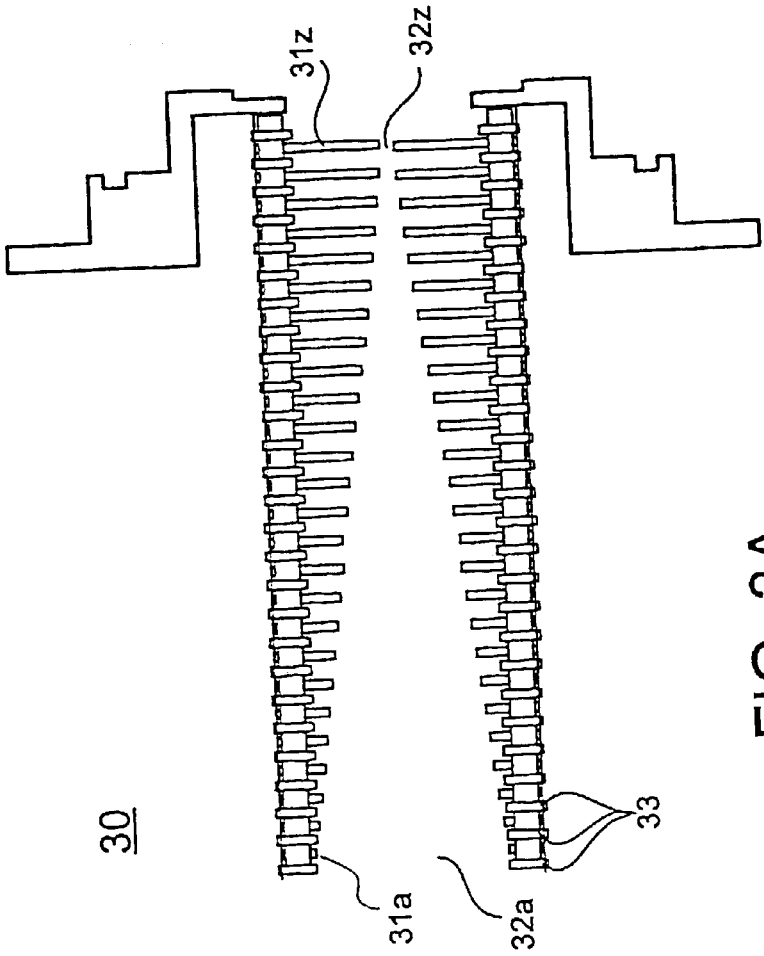
FIG. 3A is a schematic illustration of a funnel lens in cross-section perpendicular to the central axis of the device.

The funnel lens (30) mounted in Chamber 1 (FIG. 1A) is modeled after the design of Shaffer et al. (17–19) and is shown schematically in cross-section in FIG. 3A. It comprises 26 square stainless steel plates (31*a–z*) with central circular apertures, (32*a–z*, e.g., 1.27 mm thick plates) that are stacked and spaced with insulating spacers (33) on an insulator support (34) (e.g., spaced 1.27 mm apart). The inner apertures (32*a–z*) in the plates decrease linearly from the first plate 31*a* (e.g., 26 mm aperture in the first plate) to the last plate 31*z*(e.g., 2 mm aperture in the last plate). FIGS. 3A, 3B, and 3C illustrate axial views of the first and last plates in the funnel lens.

Each plate in the funnel lens is electrically connected to the next plate by a large value resistor (0.5–20 Ohm) to form a linear resistor chain. A linear d.c. potential gradient is then formed on the plates of the ion funnel by applying a large voltage, typically 200–1000 V, through a large value resistor and a small voltage, typically (100 V) similarly connected to the last plate (31*z*). A radio frequency voltage is applied to the lens such that each plate is about −180 degrees out of phase with adjacent plates. To accomplish this the even numbered plates (e.g., 31*b*, 31*d*, etc.) are connected to a bus bar through a high voltage capacitor (200–1000 pF) and the odd numbered plates (e.g., 31*a*, 31*c*, etc.) are similarly connected to a second bus bar. An opposite phase of the R.F. potential is applied to each of the bus bars. Typical R.F. amplitudes and frequencies used are 50–400 V pp and 0.7–2 MHz, respectively. The funnel lens is described in more detail in U.S. Pat. No. 6,107,628 which is incorporated by reference herein in its entirety.

Octopole Ion Guide.

Ions exiting the funnel lens are transmitted though a 1–2 mm diameter-aperture (7*a*) into Chamber 2 (FIG. 1A) held at or near ground potential. The ions are guided through Chamber 2 by a radiofrequency-only octopole (35) to an extractor (19)/accelerator lens (41) system. During passage through the octopole, the ions undergo collisions with the residual background gas which lead to translational cooling of ions. A radiofrequency only octopole is a standard device in the art and is not described in further detail.

Several different octopoles were designed and tested for ion transmission. The octopole having the smallest inscribed diameter (having dimensions below) exhibited the best ion transmission. The preferred dimensions and parameters were as follows: Rod diameter=2.38 mm, inscribed circle diameter=4.76 mm, rod length=127 mm, RF frequency= 0.7–2 kHz, peak-to-peak voltage=100–700 Volts, with a phase match better than 20 deg. Those of ordinary skill in the art can, however, select radiofrequency for application to a multipole device of selected geometry, including an octopole device, to obtain desired ion guiding.

It is generally known in the art that ions can be focused, using R-F multipole lens devices in which an even number of rods (or poles) are evenly spaced about a central axis. Such lens can have 4, 6, 8 or more rods and are designated quadrupole, hexapole, octopole or more generally multipole devices, respectively, dependent upon the number of poles used. In these devices the phase of the RF is varied between adjacent poles to confine ions. It is generally known in the art that RF multipole devices can be used to trap or confine charged particles when operated at appropriate RF frequencies and amplitudes. In such devices charged particles tend to be confined to the inner region (near the device axis) which is lower field or relatively field free. Increasing the number of rods (or poles) in the multipole lens generally increases the region of lower field or no field.

Extraction Ion Optics

Figure 4:
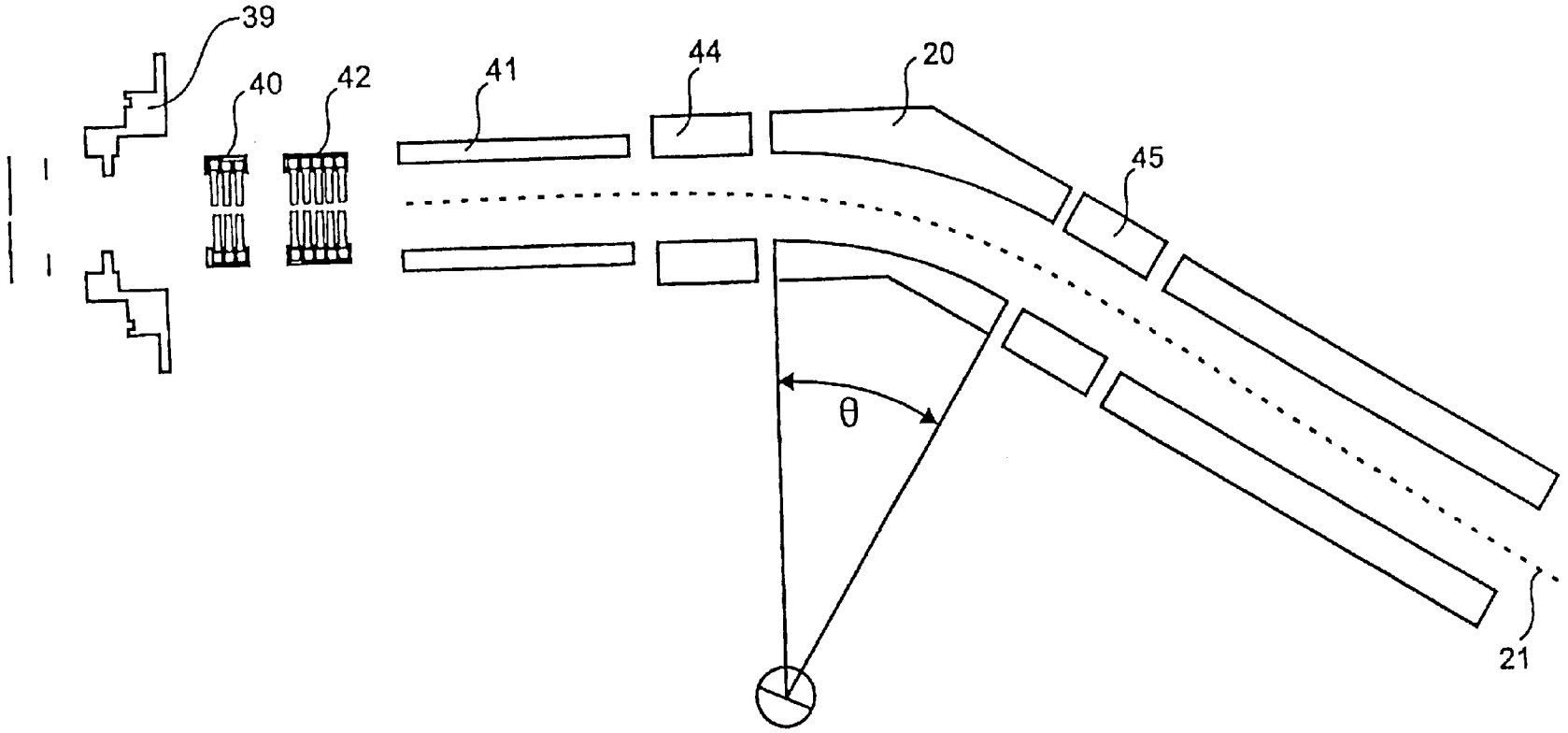
FIG. 4 is a schematic illustration of the acceleration lens, the electrostatic analyzer elements and other device elements in chamber three of an exemplary instrument of this invention.

FIG. 4 illustrates the components of Chamber 3 (FIG. 1A) and the magnetic flight tube (15). The extraction electrostatic lens (40) mounted on support 39 and insulated from the support with insulator 38. The extraction lens provides for efficient extraction of ions from the octopole ion guide, transmitting them through the 1–2 mm diameter conductance limit separating Chamber 2 from Chamber 3 (7*b*). The ions are then refocusing by an Einzel lens (42) which is mounted in Chamber 3 on the bulkhead separating Chambers 2 and 3. Einzel lenses are standard commercially available devices for use in ion optics systems and are not described in detail herein. The voltages applied to the lens elements are typically in the 0 to 200 V range.

Acceleration Lens

The acceleration lens (41) provides the ions with well-defined, tunable kinetic energy and it focuses the ion beam for further handling by the electrostatic sector. The range of acceleration voltages is matched to the magnetic field strength and for specific embodiments, using the magnet design of U.S. Pat. No. 6,182,831 and a magnetic field strength of about 1.6 Tesla, acceleration voltages of about 1–2 kV are used. The acceleration lens consists of a stack of several electrodes 43 to which negative d.c. potentials are applied. The last lens element is maintained at the acceleration potential that defines the ion kinetic energy. Each lens element is made from a 35.5 mm square, 0.635 mm thick stainless steel plate with a 4 mm diameter hole in the center. The Einzel lens and acceleration lens have cylindrical symmetry. The lens geometry and potentials have been determined from theoretical modeling using ion-trajectory simulation software (20). The acceleration lens focuses the ion beam to provide a virtual object in the focal point of the electrostatic analyzer which is 113.3 mm from the ESA upbeam edge.

Faraday Cages (Electrostatic Potential Shielding Devices)

The Faraday cages (44 and 45) provide a drift space of well-defined potential that allows the accelerated ions to reach the electrostatic sector analyzer and ion dispersion magnet without loss or gain of kinetic energy. The front Faraday cage (44) precedes the electrostatic sector analyzer and is floated at the acceleration potential. The rear Faraday cage (45) is placed after the electrostatic sector analyzer and is floated at the acceleration potential. The rear Faraday cage is electrically connected to the magnet flight tube, which is also floated at the acceleration potential. The cages consist of stainless steel frames covered with wire mesh to provide electrostatic shielding for the ion beam.

Electrostatic Sector Analyzer

The electrostatic sector analyzer (ESA, 20) disperses the accelerated ion beam by kinetic energy. It consists of two cylindrical segments precision-machined of stainless steel. The ESA is a device that is standard in the art. In a specific embodiment, the sector has an angle of 31.820 in the Mattauch-Herzog geometry (see, Nier and Schluter 21, and McDowell 22) with a radius of 160.3 mm and a pole gap of 22.25 mm, which produces a paraxial beam of ions at the accelerating potential. Shunts 46 of 22.25 mm in length precede and follow the electrostatic analyzer to both terminate the field of the electrostatic analyzer and to provide for a small amount of horizontal steering of the ion beam if required. The ion beam can be steered by applying a voltage difference on the shunt plates.

Magnetic Flight Tube

The magnet flight tube (15) is a separate element that fits between the poles of the magnet providing for carrying ions through the magnet. Its dimensions are not otherwise critical. As indicated above in a preferred embodiment the magnetic flight tube is electrically insulated from the main chamber, but not from the magnet which is floated at the acceleration voltage.

Linear Dispersion Magnet

In the preferred embodiment, a linear dispersion magnet based on a design described in U.S. Pat. No. 6,182,831, is employed for spatial dispersion of accelerated ions. The linear dispersion magnet is a permanent magnet with poles shaped such as to provide an inhomogeneous magnetic field along the focal plane, which is parallel to the outside edge of the magnet. In a specific embodiment, the magnetic focal plane is 38 cm long and 1–3 cm outside the edge of the magnet depending on the ballistic entrance at normal entrance angle. The inhomogeneous field causes ion trajectory deflection, such that the focal points of mass-separated ion beams lie in the focal plane and are spaced equidistantly as a linear function of ion m/z values. The magnet is set on Thomson rails and can be slid in and out to accommodate the evacuated magnet flight tube. The magnet flight tube may be insulated from the magnet poles by a polymer foil, but in the preferred configuration the magnet flight tube and magnet are floated at the acceleration voltage.

Deflector and Deceleration Lens Assembly

FIG. 5A illustrates an exemplary arrangement of deflector lens (28), deceleration lens (29) with six lens elements (66) eight channels (57) and collector array (30). Mass dispersed ion trajectories exiting the magnet, being deflected, decelerated and refocused to the collector array are also illustrated (for the m/z range of 200–600).

The deflection lens (28) consists of two plane-parallel, high transmission (>90%), wire meshes (76 and 77) spaced about 4.5 mm apart. One mesh (76) is mounted flush on the exit side of the magnet flight tube and maintained at the flight tube potential (in the preferred embodiment at about 1–2 kV, the acceleration voltage). The other mesh (77) is floated at a higher voltage (5–7 kV) which is matched with the voltage applied to the first element of the deceleration lens (below). The electrostatic field between the meshes provides tangential acceleration to the mass-dispersed ions exiting from the magnet and deflects the ions simultaneously to a final deflection angle (68) which is about 30–45 degrees with respect to the normal of the magnet focal plane. An illustration of ion deflection caused by the deflector lens is provided in FIG. 5A. The normal to the magnetic focal plane (78) as well as the deflection angle (80*h*) of a heavier ion and the deflection angle of a lighter ion (80*l*). The deceleration lens assembly is rotated by the same angle with respect to the magnet focal plane as the magnet so that it is about normal to that focal plane.

The extent of ion deflection depends only weakly on the ion mass, so that the mass-dispersed ions enter the deceleration lens at an angle within about 1 degree of the normal to the focal plane. The use of the deflection lens is dictated by the large and mass-dependent exit angles (with respect to the normal) of the mass-dispersed ions exiting the inhomogeneous magnet. This single deflection lens can be replaced by individual deflectors for each channel. However, the use of a single lens is preferred across multiple channels.

Deceleration Lens

The deceleration lens (29) allows control or selection of the ion velocity and kinetic energy of the dispersed ions. Typically the lens is used to decrease the ion kinetic energy (preferably to less than about 15 eV and more preferably to 5 eV) to insure non-destructive landing in the matrix of the collector channel. The deceleration lens consists of a plurality of elements (66*a–f*, are illustrated) maintained at decreasing potentials (from the element closest to the magnet, 66*a*) to achieve ion deceleration and refocusing. The elements contain a plurality of channels (67), eight equal width channels are illustrated in the deceleration array lens of FIG. 5A. Channels can have the same or different widths. The thickness (t) and spacing (s) of the elements can be varied to obtain desired deceleration and focusing, as is known in the art. Instruments of this invention can be constructed to have at least about 256 channels. Ion deceleration occurs in stages (i.e., step-wise) between the elements, from the initial kinetic energy of 5–7 keV for ions entering the lens to a desired lower kinetic energy, typically and preferably 5–15 eV, for ions landing on the collector array. FIG. 5A illustrates exemplary voltages applied to six elements. Exemplary electrostatic deceleration lens designs that can be employed in the instrument of this invention have been described (Turecek et al.; Kofel et al.; Vestal et al.; and O'Connor et al., 23–26, respectively).

Figure 5B:
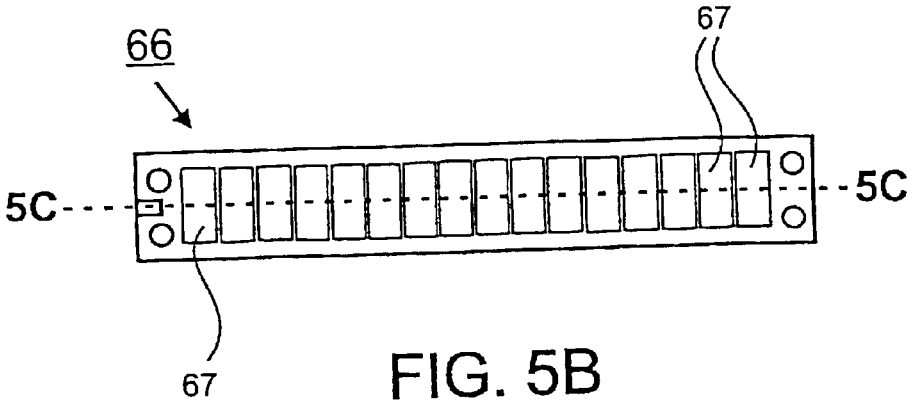
FIGS. 5B and C provide illustrations of an element of the deceleration lens.
Figure 5C:
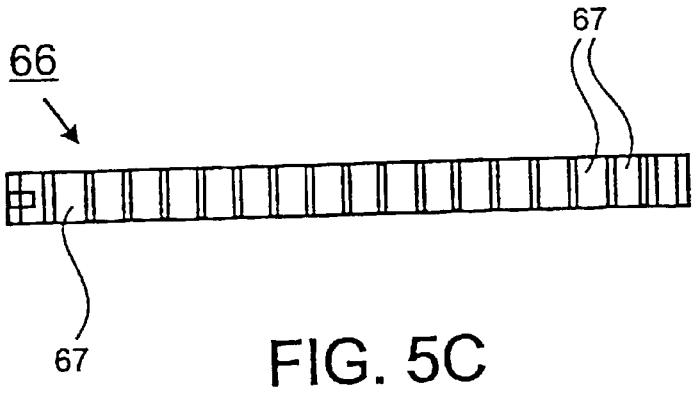

Exemplary applied potentials are illustrated in FIG. 5A. The distance between the last deceleration element and the collector bin in the preferred embodiment is about 2 mm, but can be designed to be smaller or larger. A single element of the deceleration lens is illustrated in FIGS. 5B (side view) and 5C (top cutaway view). The illustrated element (66) contains 16 channels (67) approximately equally spaced along the element each preferably for receiving only ions of the same mass. On passage through the stack of elements, ions are decelerated and refocused within their channels.

Ion Collector Array

The ion collector is an array (30) of bins (preferably linearly matched to the channels in the deceleration lens array) that provide for collection of the mass-separated, decelerated ions by soft landing in or on a liquid or solid matrix. Each bin can comprise a collector electrode and a counter electrode. The collector electrode can have various shapes, i.e., pin-, rod-, well-, cup- or spoon-shaped and is made of a metallic or nonmetallic electrically-conductive material. The counter electrode is analogously shaped (pin-, rod-, well-, cup- or spoon-shaped) and made of a metallic or non-metallic electrically conductive material. Alternatively, the counter-electrode can be a wire mesh. The collector and counter electrode pairs are mounted on the collector array on a non-conductive support to trap spatially dispersed ions. The collector array can be retracted from the instrument to allow for physical collection of separated components in collector bins.

The mass separator of this invention can be employed in the separation of components of various types and sizes. The mass separator can be employed to separate large organic or inorganic species, such as organic or inorganic polymer components, to separate relatively small organics, particularly pharmaceutically-active or potentially pharmaceutically active species (e.g., steroids and derivatives thereof). The mass separator of this invention can be employed, in particular, to separated biological components found in biological samples, such as biological fluids (e.g., blood, tissue, serum, urine, CSF, or culture fluids of plant, animal or microbial cells).

In a specific application, the mass separator can be employed to separate components in a mixture which contains one or more components that can be in free form or in bound form, where bound form means that a component is associated, by electrostatic, ionic, hydrogen or other forms of bond formation to one or more other components (which may be the same, e.g., dimer, trimer or multiyear formation, or different, e.g., ligand-receptor interactions) and where free form means that the component is not bonded in such an association with another component. In this case, the mass separator can be employed to separate the free form (i.e., the component itself) from one or more bound forms of the component. For example, the mass separator can be employed to separate a free peptide from the peptide bound to one or more nucleic acids. The ability to soft land the bound form of the ionized component allows recovery and structural identification of such bound forms. In addition, the ability to rapidly collect such bound forms allows relatively rapid functional or activity analysis of these species and allows comparisons to be made with the free (unbound) form of the component. Further, the mass separator, which optionally allows quantization of absolute or relative amounts of different components or free and bound components, can be used to assess binding affinity of components to a variety of species. For example, the mass separator will allow assessment of relative binding affinities of a peptide to a number of different nucleic acids or the binding affinity of a given nucleic acid to a number of different peptides or proteins. Similar measurement can be employed to assess ligand affinities for receptors.

The device of this invention for preparative separation using mass spectrometry employing an electrospray ionization source has been demonstrated to provide an isolated component yield of about 85% in several experiments. In one experiment, Rhodamine B (a synthetic dye) was electrosprayed for 7 h at 7.2 nA current corresponding to 1.9 nmol of ions impinging on the collector. The collector was washed with methanol and the amount of recovered Rhodamine B was determined by ESI-MS (Bruker Esquire, Ion Trap, external calibration with standard Rhodamine solutions in methanol) as 1.6 nmol corresponding to a 100×1.6/1.9=84% yield.

In another experiment a mixture containing known amounts of Gramicidin S, Rhodamine B, and crystal violet was ionized, transmitted through the instrument of this invention and collected at 5, 10, and 15 eV landing energies. Yields of isolated components (by ESI quantitation using internal standard calibrations) were 83%, 86%, and 75% of the ion currents reaching the detector at 5, 10, and 15 eV, respectively. The yields of collected and recovered components relative to the amount of the material electrosprayed are 2.5–3.5% in the current embodiment of the instrument. The difference between the collection yields (75–86%) and the overall yield (2.5–3.5%) is believed to be due to ion transmission losses from the ESI needle to the high vacuum. The relative amounts of Gramicidin S, Rhodamine B, and crystal violet collected after landing at energies of 5, 10 or 15 eV were determined by mass spectrometric analysis of combined material collected after landing at the selected energy. No significant decomposition of the trapped components was detected even at the highest landing energy employed (15 eV).

Figure 6A:
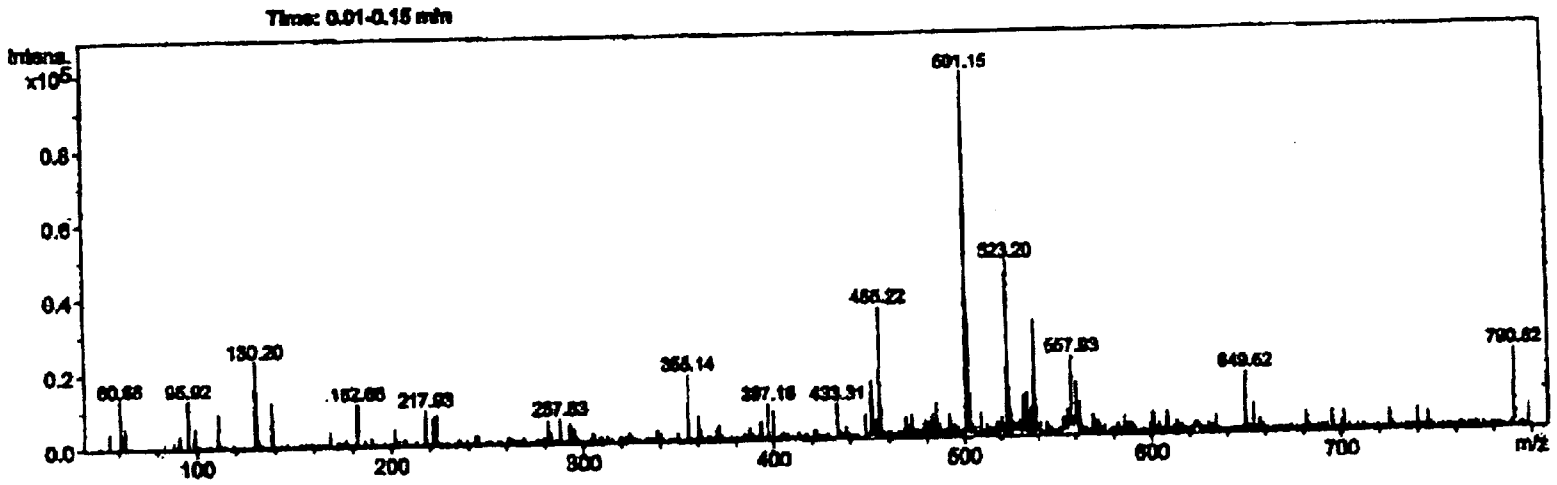
FIGS. 6A–C are spectra illustrating recovery of components of a combinatorial library. Structures of the components are given adjacent each spectrum.
Figure 6A:
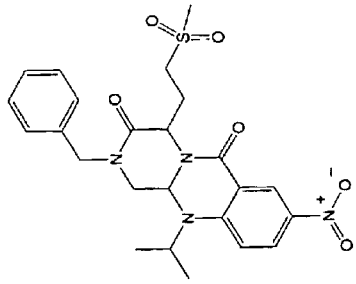
Figure 6B:
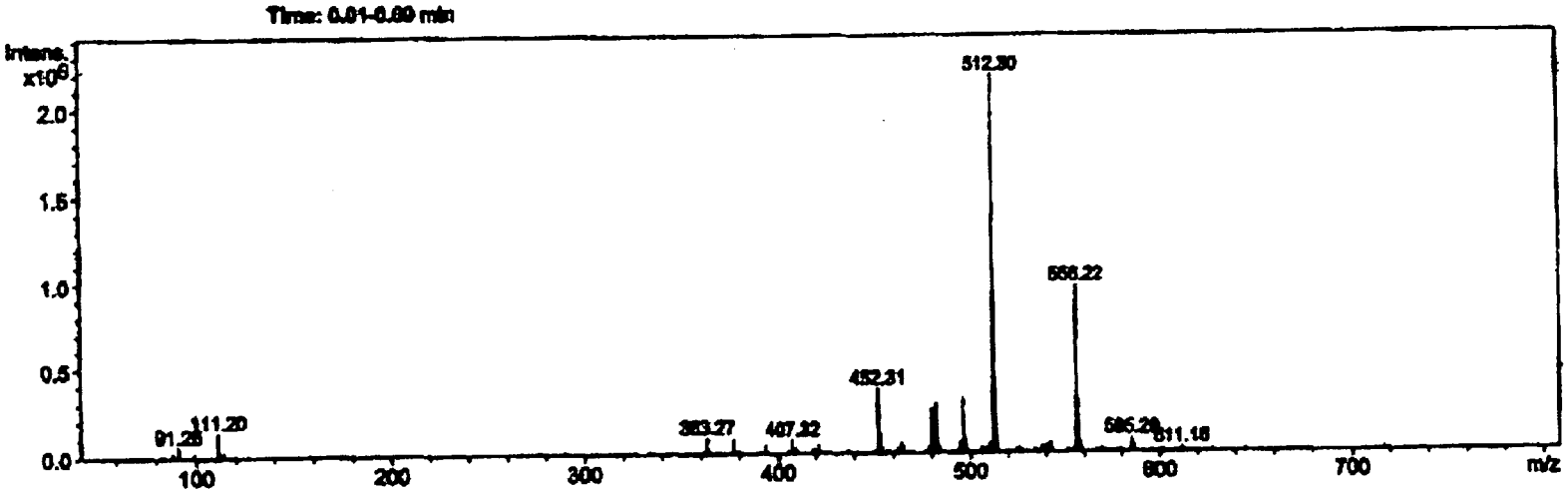
Figure 6B:
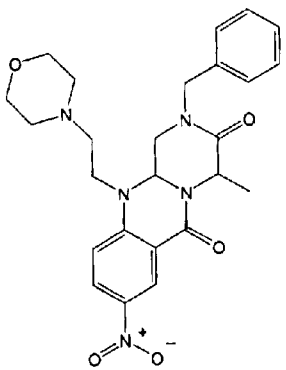
Figure 6C:
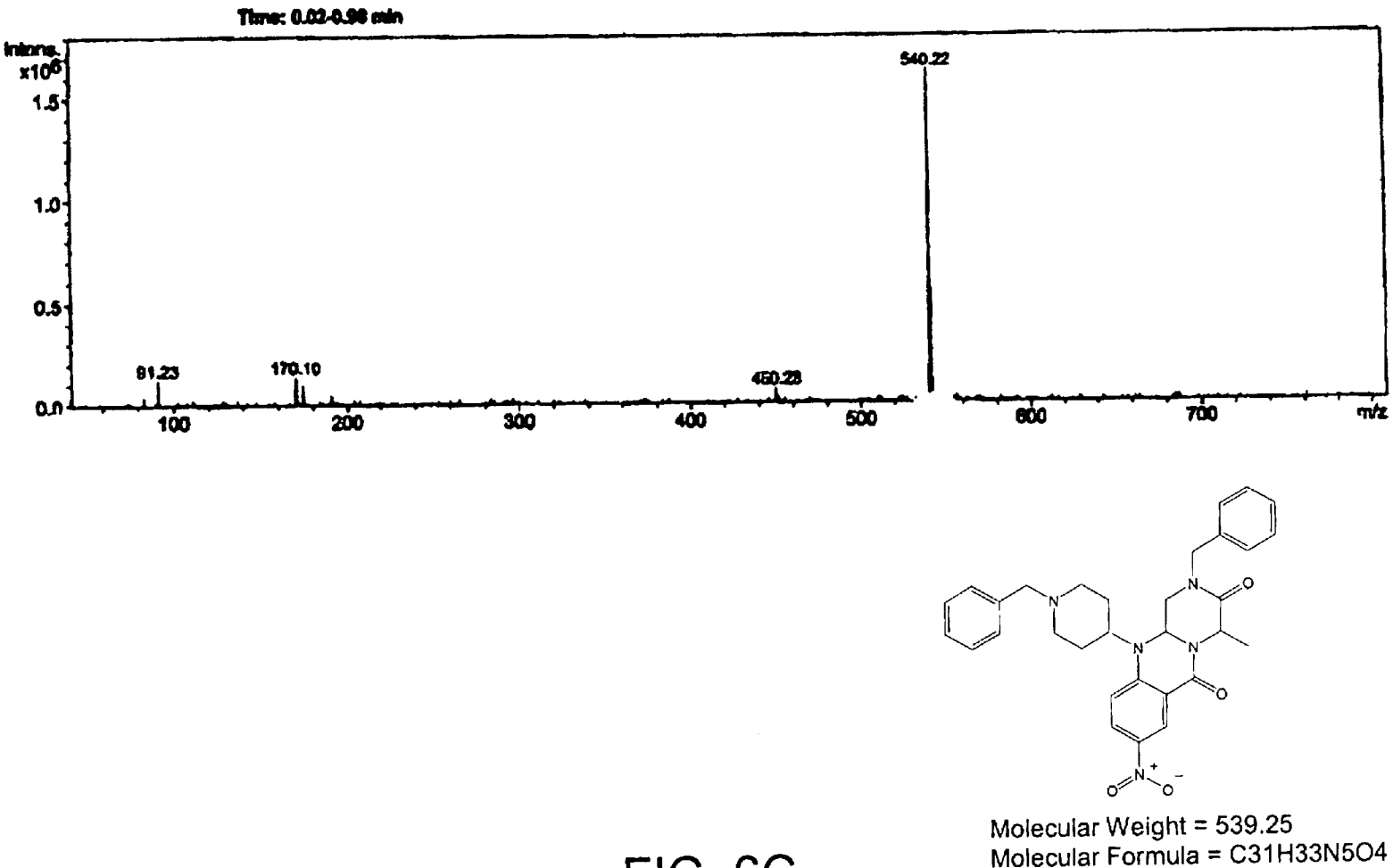

In yet another experiment, small organic molecules (molecular weight less than about 600) from a class of substituted quinazolinones (the components of a combinatorial library) were recollected in 0.4–0.5 nmol quantities and re-analyzed using ESI-MS. FIGS. 6A–6C are mass spectra (ESI-MS) of three exemplary collected components whose structures are given in the FIGS. 6A–6C. A mixture of the components was injected into the instrument of this invention and separated by collection of $MH^+$ ions after deceleration at 10 eV onto a collector array. The collected samples were recovered by washing the collectors with solvent and injecting the washes into an analytical MS instrument. FIG. 6C is a particularly good example of the collection of a mixture component (having molecular mass m/z=539) without a significant amount of destruction.

Thus, the device of this invention and methods employing this device provide for efficient separation and further allow quantitation of components from mixtures, particularly of biological components from biological samples. Components of mixtures can be collected using the instrument of this invention without significant destruction if desired. The device can also be used to separate organic compounds containing isotopes of atoms and particularly those isotopes that differ form each other by more than 1 Dalton, e.g. $^{35}Cl/^{37}Cl$, $^{79}Br/^{81}Br$, $^{32}S/^{34}S$ etc. The detection of these isotopes in unnatural abundances is useful, for example, in the identification of drug metabolites.

Furthermore, the device can be used for modification of matrices or substrates on landing of ionic species. For example, mass-separated ions can be captured into a matrix or onto a substrate for selectively modifying the structural, functional and/or physical or chemical properties of the matrix or substrate by the mass-selected ionic species landed. Mass selected ions landed into an organic or inorganic polymer, for example, can be employed to modify the functional properties of the polymers.

Those of ordinary skill in the art will appreciate that specific device elements, techniques, and materials other than those specifically disclosed herein can be employed in the practice of the invention as described herein without resort to undue experimentation and without departing from the spirit and scope of the invention. It will also be appreciated that device elements, techniques and materials functionally equivalent to those specifically disclosed herein are known in the art. All such functional equivalents are intended to be encompassed by this invention.

All references cited herein are incorporated by reference herein to the extent that they are not inconsistent with this disclosure.

REFERENCES (1) White, F. A. and Wood, G. M. (1986) "*Mass spectrometry: applications in science and engineering*," Wiley: New York, N.Y.

(2) Smith, L P. et al. (1947) Phys. Rev. 72:989.

(3) Love, L. (1973), "Electromagnetic separation of isotopes at Oak Ridge," Science 182:343.

(4) Yergey, A. L. and Yergey, A. K. (1997), "Preparative scale mass spectrometry: A brief history of the Calutron," J. Am. Soc. Mass Spectrom. 8:943–95.

(5) Siuzdak, G. et al. (1996), "Mass spectrometry and viral analysis," Them. Biol. 3:4548.

(6) Shen, J. W. et al. (1999), "Ion-ion collisions leading to formation of C—C bonds at surface: An interfacial Kolbe reaction," J. Am. Chem. Soc. 121:9762–9763.

(7) Geiger, R. J. et al. (1999), "Modifications to an analytical mass spectrometer for the soft-landing experiment," Int. J. Mass Spectrom. Ion Processes 183:415–422.

(8) Feng, B. et al. (1999), "Retrieval of DNA using soft landing after mass analysis by ESI-FTICR for enzymatic manipulation," J. Am. Chem. Soc. 121:8961–8962.

(9) Godbout, J. T. et al. (1996), "Matrix isolation of mass-selected cations: Are counterions present and how are they formed?" J. Phys. Chem. 100:2892–2899.

(10) Bromann, K. et al. (1997), "Hard and soft landing of mass-selected Ag clusters on Pt(I 1 1)," Surf. Sci. 377:1051.

(11) Bromann, K. et al. (1996), "Controlled deposition of size-selected silver nanoclusters," Science 274:956.

(12) Nacer, B. et al. (1997), "Deposition of metallic clusters on a metallic surface at zero initial kinetic energy. Evidence of implantation and site exchanges," Phys. Rev. B 56:10590.

(13) Miller, A. et al. (1997), "Soft-landing of polyatomic ions at fluorinated self-assembled monolayer surfaces," Science 275:1447–1450.

(14) Luo, H. et al. (1998), "Soft landing of polyatomic ions for selective modification of fluorinated self-assembled monolayer surfaces," Int. J. Mass Spectrom. Ion Processes 174:193–217.

(15) Shen, J. W. et al. (1999), "Soft landing of ions onto self-assembled hydrocarbon and fluorocarbon monolayer surfaces," Int. J. Mass Spectrom. 183:423–435.

(16) Shen, J. W. et al. (1999), "Chemical modification of fluorinated self-assembled monolayer surfaces using low-energy ion beams for halogen and pseudohalogen transfer," J. Mass Spectrom. 34(3):54–63.

(17) Shaffer, S. A. et al. (1997), "A novel ion funnel for focusing ions at elevated pressure using electrospray ionization mass spectrometry," Rapid. Comm. Mass Spectrom. 11:181–'I-1817.

(18) Shaffer, S. A. et al. (1998), "An ion funnel interface for improved ion focusing and sensitivity using electrospray ionization mass spectrometry," Anal. Chem. 70:4111–4119.

(19) Shaffer, S. A. et al. (1999), "Characterization of an improved electrodynamic ion funnel interface for electrospray ionization mass spectrometry," Anal. Chem. 71:2957–2964.

(20) Dahl, D. A., (1995) SIMION 3D Version 6.0 Users Manual. Publication No. INEL 95/0403, Lochheed Idaho Technologies Company, Id. Falls, Id.

(21) Nier, A. O. and Schlutter, D. J. (1985) "High-performance double-focusing massspectrometer," Rev. Sci. Instrum. 56:214.

(22) McDowell, C. A. (1963) (ed.) *Mass Spectrometry*, McGraw-Hill, New York pp. 210–216.

(23) Turecek, F.; Gu, M. Shaffer, S. A. (1992) *J. Am. Soc. Mass Spectrom* 3:493–501.

(24) Kofel, P.; Reinhard, H. Schlunegger, U. (1991) *Org. Mass Spectrom.* 2:322.

(25) Vestal, M. L.; Blakley, C. R.; Ryan, P. W.; Futrell, J. H. (1976) *Rev. Sci. Instrum.* 47:15.

(26) O'Connor, P. J.; Leroi, G. E.; Allison, J. (1991) *J. Am. Mass. Spectrom.* 2:322.

We claim:

1. A method for separation of components of a mixture which comprises the steps:

(a) non-destructively ionizing one or more of the components of the mixture;

(b) accelerating the ionized components to a high selected kinetic energy of about 1 KeV or higher;

(c) selecting accelerated ionized components having a selected high kinetic energy;

(d) spatially separating the ionized components having a selected high kinetic energy by mass in a magnetic field;

(e) decelerating the spatially mass-separated ionized components to a low kinetic energy;

(f) non-destructively trapping and neutralizing the ionized components thereby separating one or more components of the mixture; and (g) optionally quantifying said components of the mixture.

2. The method of claim 1 wherein the one or more components are nondestructively ionized using electrospray ionization.

3. The method of claim 1 wherein the one or more ionized components of selected kinetic energy are spatially separated by mass in a linear magnetic analyzer.

4. The method of claim 1 wherein the one or more ionized components spatially separated by mass are decelerated to a kinetic energy less than about 5 electron volts prior to trapping.

5. The method of claim 1 wherein the ionized components are formed at a pressure of approximately 1 atmosphere further comprising the step of transporting the ionized components to a region of low pressure ranging from about $10^{-5}$ to $10^{-6}$ Torr.

6. The method of claim 5 wherein the ionized components are transported through a funnel lens and an octopole ion guide.

7. The method of claim 1 wherein ion currents in the range of nanoamps are generated.

8. The method of claim 1 wherein the one or more ionized components are trapped.

9. The method of claim 1 wherein the one or more ionized components of selected kinetic energy are selected by passage through an electrostatic analyzer.

10. The method of claim 9 wherein the one or more ionized components of selected kinetic energy are passed through a Faraday cage to maintain their kinetic energy.

11. The method of claim 1 wherein the components are organic molecules of the same or similar structure containing two or more isotopes of the same atom.

12. The method of claim 1 wherein the isotopes are isotopes of chlorine, bromine or sulfur.

13. The method of claim 1 wherein the matrix comprises an organic or inorganic polymer.

14. The method of claim 1 wherein one or more ion components can be collected at a rate of about 10 picomole/hr or more.

15. The method of claim 1 wherein the ionized components are biological molecules.

16. The method of claim 15 wherein the ionized components are selected from peptides, proteins, nucleic acids, ligands, and receptors.

17. The method of claim 1 wherein the mixture to be separated is a biological sample.

18. The method of claim 1 wherein the mixture comprises one or more components that can exist in a free form or in a bound form in which the component is bonded through covalent, ionic or hydrogen bonds to another chemical species.

19. The method of claim 18 wherein in the bound form the component is bonded to a peptide, protein, or nucleic acid.

20. The method of claim 18 wherein the components separated by mass include at least one pair of free and bound components.

21. A multichannel mass separator which comprises:

(a) an electrospray ionizer for generating ionized components from a sample;

(b) an acceleration lens for accelerating ionized components at low pressures to high kinetic energy;

(c) an electrostatic analyzer for selection of ionized components having selected kinetic energy;

(d) a magnetic analyzer for spatial dispersion of ionized components having selected high kinetic energy as a function of mass;

(e) a deceleration lens for decreasing the kinetic energy of the acceleration ionized components; and (f) a collection array for trapping spatially mass separated ions.

22. The multichannel mass separator of claim 21 further comprising an ion transmission element for transporting ionized components formed at high pressure for the electrospray ionized to low pressure in the acceleration lens.

23. The multichannel mass separator of claim 22 wherein the ion transmission element comprises a funnel lens, octopole ion guide and an ion extraction lens.

24. The multichannel mass separator of claim 23 further comprising a Faraday cage before, after or both before and after the electrostatic analyzer.

25. The multichannel separator of claim 21 wherein the magnetic analyzer is a linear magnetic dispersion analyzer.

26. The multichannel separator of claim 25 wherein the linear magnetic dispersion analyzer comprises an ion deflection lens.

27. The multichannel separator of claim 21 provided with vacuum housing and appropriate differential pumping such that the acceleration lens and the electrostatic analyzer are held at a pressure of between about $1\times10^{-6}$ to $5\times10^{-6}$ Torr and the magnetic analyzer is held at a pressure between about $10^{-6}$ and $10^{-5}$ Torr.

28. The multichannel separator of claim 23 wherein the electrospray ionizer is operated at about 1 atmosphere of pressure and the separation is provided with vacuum housing and differential pumping such that the funnel lens is held at a pressure between 0.1 to 5 Torr, the octopole ion guide is held at a pressure of $5\times10^{-2}$ to $5\times10^{-4}$ Torr and the acceleration lens and electrostatic analyzer are held at a pressure between about $1\times10^{-6}$ to about $5\times10^{-6}$ Torr.

* * * * *